US009450346B1

(12) United States Patent
Garcia et al.

(10) Patent No.: US 9,450,346 B1
(45) Date of Patent: Sep. 20, 2016

(54) ELECTRICAL CONTACT PIN HAVING A LEDGE AND/OR A GROOVE COUPLED TO A PRINTED CIRCUIT BOARD

(71) Applicant: MOTOROLA SOLUTIONS, INC., Schaumburg, IL (US)

(72) Inventors: Jorge L. Garcia, Plantation, FL (US); Richard K. Schmid, Sunrise, FL (US); Anthony J. Suppelsa, Parkland, FL (US)

(73) Assignee: Motorola Solutions, Inc., Schaumburg, IL (US)

( * ) Notice: Subject to any disclaimer, the term of this patent is extended or adjusted under 35 U.S.C. 154(b) by 0 days.

(21) Appl. No.: 14/887,760

(22) Filed: Oct. 20, 2015

(51) Int. Cl.
*H01R 13/40* (2006.01)
*H01R 13/66* (2006.01)
*H01R 13/52* (2006.01)

(52) U.S. Cl.
CPC ..... *H01R 13/665* (2013.01); *H01R 13/521* (2013.01); *H01R 13/5202* (2013.01)

(58) Field of Classification Search
CPC H01R 13/52; H01R 13/521; H01R 13/5219; H01R 13/62; H01R 13/627; H01R 13/6271
USPC ..... 439/271–285, 587–589
See application file for complete search history.

(56) References Cited

U.S. PATENT DOCUMENTS

| | | | | |
|---|---|---|---|---|
| 4,623,391 | A | 11/1986 | Seitz | |
| 5,223,996 | A | 6/1993 | Read et al. | |
| 6,227,872 | B1 * | 5/2001 | Stephenson | H01R 13/405 439/500 |
| 8,439,191 | B1 | 5/2013 | Lu | |
| 8,968,005 | B2 * | 3/2015 | Hirakawa | H01R 12/73 439/65 |
| 2004/0089570 | A1 | 5/2004 | Chien et al. | |
| 2006/0040521 | A1 * | 2/2006 | Gordon | H05K 13/0069 439/66 |
| 2011/0143587 | A1 * | 6/2011 | Cocquyt | H01R 13/521 439/587 |
| 2014/0038458 | A1 * | 2/2014 | Bausch | H01R 12/714 439/587 |
| 2015/0180158 | A1 * | 6/2015 | Arai | H01R 13/5216 439/588 |
| 2015/0207264 | A1 * | 7/2015 | Arai | H01R 13/405 439/660 |

* cited by examiner

*Primary Examiner* — Chandrika Prasad
(74) *Attorney, Agent, or Firm* — Michael Best & Friedrich LLP

(57) ABSTRACT

An electrical contact pin for a printed circuit board. The electrical contact pin includes a first cylindrical portion having a first diameter and a second cylindrical portion extending from the first cylindrical portion. The second cylindrical portion has a second diameter larger than the first diameter. The second cylindrical portion includes a ledge configured to press against a wall of a printed circuit board. The second cylindrical portion further includes a groove configured to receive a sealing material.

20 Claims, 6 Drawing Sheets

ELECTRICAL CONTACT PIN HAVING A LEDGE AND/OR A GROOVE COUPLED TO A PRINTED CIRCUIT BOARD

BACKGROUND OF THE INVENTION

Connector systems are commonly used to connect printed circuit boards to various devices including, for example, peripheral electronic devices. Current connector systems include, for example, micro universal serial bus (USB) connectors, and other types of connector blocks, plugs, sockets, headers, and flex connections. However, these systems are often expensive, require significant numbers of components and space, do not provide adequate sealing from dust, dirt, water and other environmental contaminants, are difficult to clean, and suffer from short life cycles.

Accordingly, there is a need for a connector system for a printed circuit board that has a low cost, a reduced number of parts, has reduced space requirements, is well-sealed, is easy to clean, and has a long life.

BRIEF DESCRIPTION OF THE SEVERAL VIEWS OF THE DRAWINGS

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1:
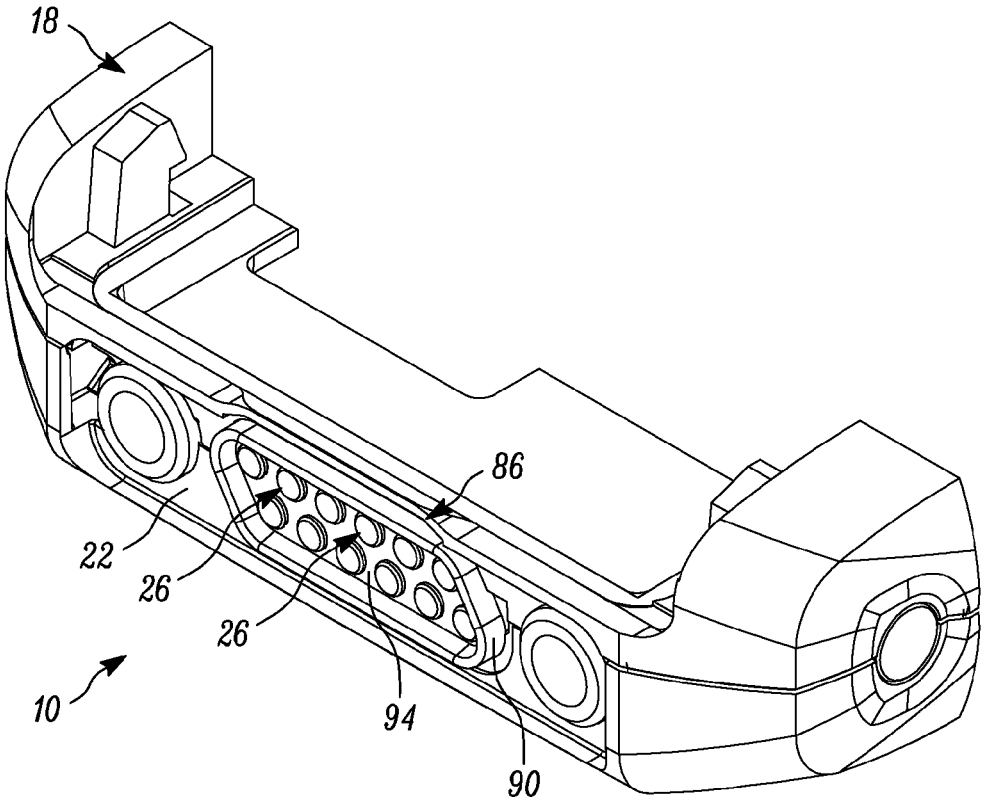
FIG. 1 illustrates a connector system in accordance with one embodiment, a portion of which is exposed outside of an electronic device, only a portion of the electronic device being shown.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION OF THE INVENTION

One embodiment provides an electrical contact pin for a printed circuit board. In one particular example, the electrical contact pin includes a first cylindrical portion having a first diameter, and a second cylindrical portion extending from the first cylindrical portion. The second cylindrical portion has a second diameter larger than the first diameter. The second cylindrical portion includes a ledge configured to press against a wall of a printed circuit board. The second cylindrical portion further includes a groove configured to receive a sealing material.

Another embodiment provides a connector system including a printed circuit board having a top surface and a side surface extending from the top surface. The connector system further includes an electrical contact pin coupled to the printed circuit board. The electrical contact pin has a first cylindrical portion coupled directly to the top surface. The first cylindrical portion has a first diameter. The electrical contact pin has a second cylindrical portion extending from the first cylindrical portion. The second cylindrical portion has a second diameter larger than the first diameter. The second cylindrical portion includes a ledge in direct contact with the side surface.

Yet another embodiment provides a connector system including a printed circuit board having a top surface and a side surface extending from the top surface. The connector system further includes an electrical contact pin coupled to the printed circuit board. The electrical contact pin has a first cylindrical portion coupled directly to the top surface, the first cylindrical portion having a first diameter. The electrical contact pin has a second cylindrical portion extending from the first cylindrical portion, the second cylindrical portion having a second diameter larger than the first diameter. The second cylindrical portion includes a groove. The connector system further includes a sealing material disposed within the groove.

FIGS. 1 through 7 illustrate a connector system 10 for coupling a printed circuit board 14, which is shown in FIGS. 2 through 7, to, for example, a peripheral device, such as an electronic device. The connector system 10 could be used to connect or couple various other devices to the printed circuit board 14.

Figure 2:
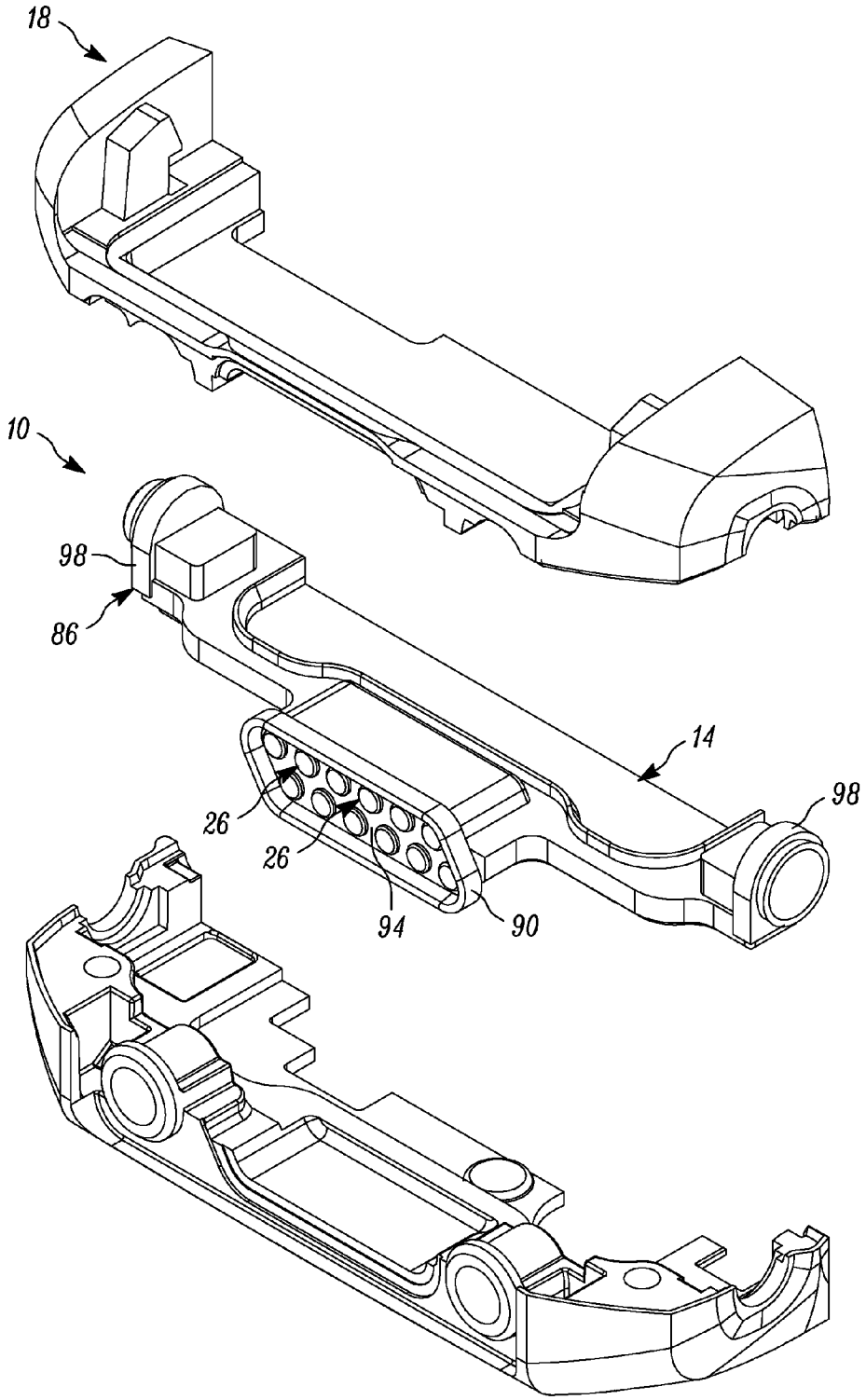
FIGS. 2 and 3 illustrate exploded partial views of the electronic device from FIG. 1, showing a location of the connector system within the electronic device.
Figure 3:
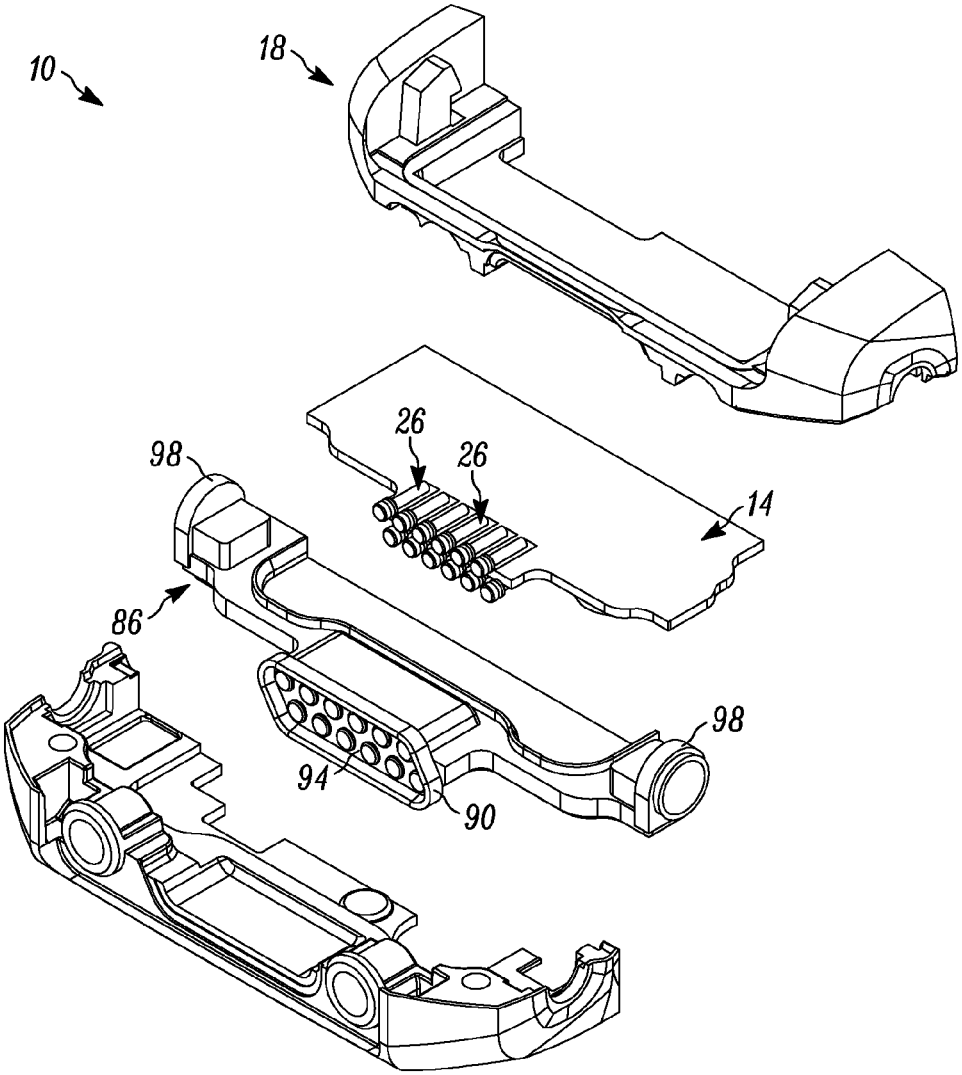

With reference to FIGS. 1 through 3, in the illustrated embodiment the connector system 10 is coupled to and disposed partially within an electronic device 18 (e.g., a mobile communication device such as a two-way radio or a mobile telephone). Only a portion of the electronic device 18 is shown. As illustrated in FIG. 1, a portion of the connector system 10 is exposed along a bottom 22 of the electronic device 18, so that a peripheral electronic device or piece of equipment (e.g., charger, etc.) may be removably coupled to the electronic device 18 and to the printed circuit board 14 disposed therein. Other embodiments include different locations for the connector system 10. In some embodiments, the connector system 10 is disposed at least partially within a device other than an electronic device 18.

Figure 4:
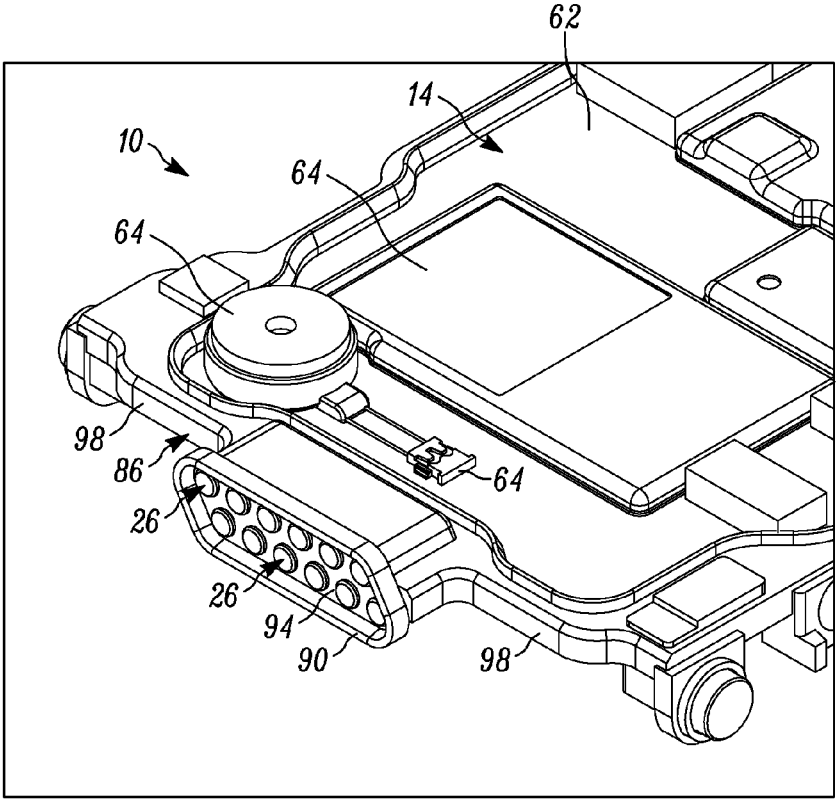
FIG. 4 illustrates the connector system of FIG. 1, showing a printed circuit board with electronic components disposed thereon, electrical contact pins, and a sealing material.
Figure 5:
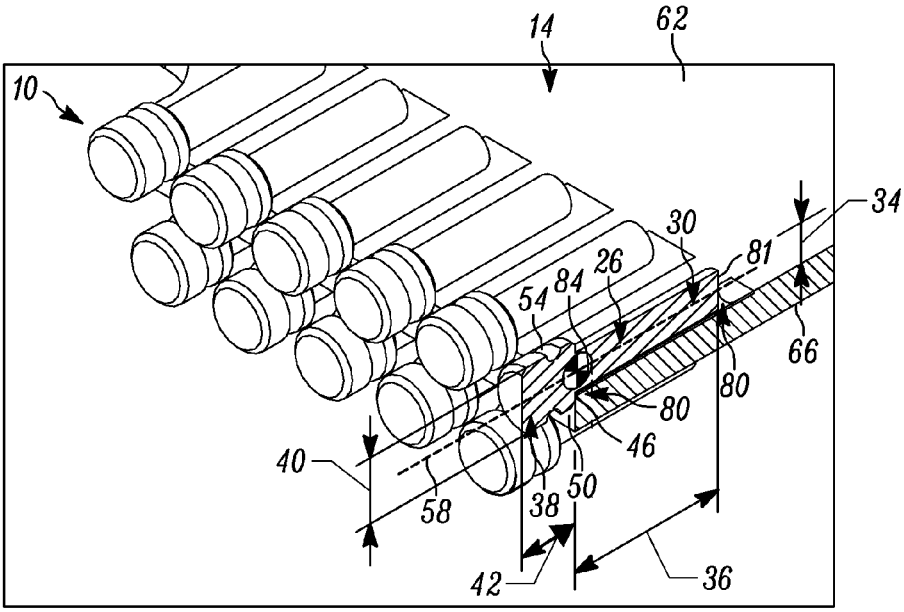
FIG. 5 illustrates a cross-sectional view of the connector system of FIG. 1.

With reference to FIGS. 1 through 7, the connector system 10 includes at least one electrical contact pin 26. In the illustrated embodiment, the connector system 10 includes twelve electrical contact pins 26, although other embodiments include different numbers and arrangements of electrical contact pins 26 than that illustrated. In the illustrated embodiment, each of the electrical contact pins 26 is identical in size and shape. In some embodiments, at least two of the electrical contact pins 26 are not identical in size and/or shape. As illustrated in FIG. 5, each of the electrical contact pins 26 includes a first portion 30 having a first width 34 and a first length 36. The first portion 30 is cylindrical, and the first width 34 is a diameter of the first portion 30. Each of the electrical contact pins 26 also includes a second portion 38 extending from the first portion 30 and having a second width 40 that is larger than the first width 34, and a second length 42 that is smaller than the first length 36. The second portion 38 is cylindrical, and the second width 40 is a diameter of the second portion 38.

Figure 6:
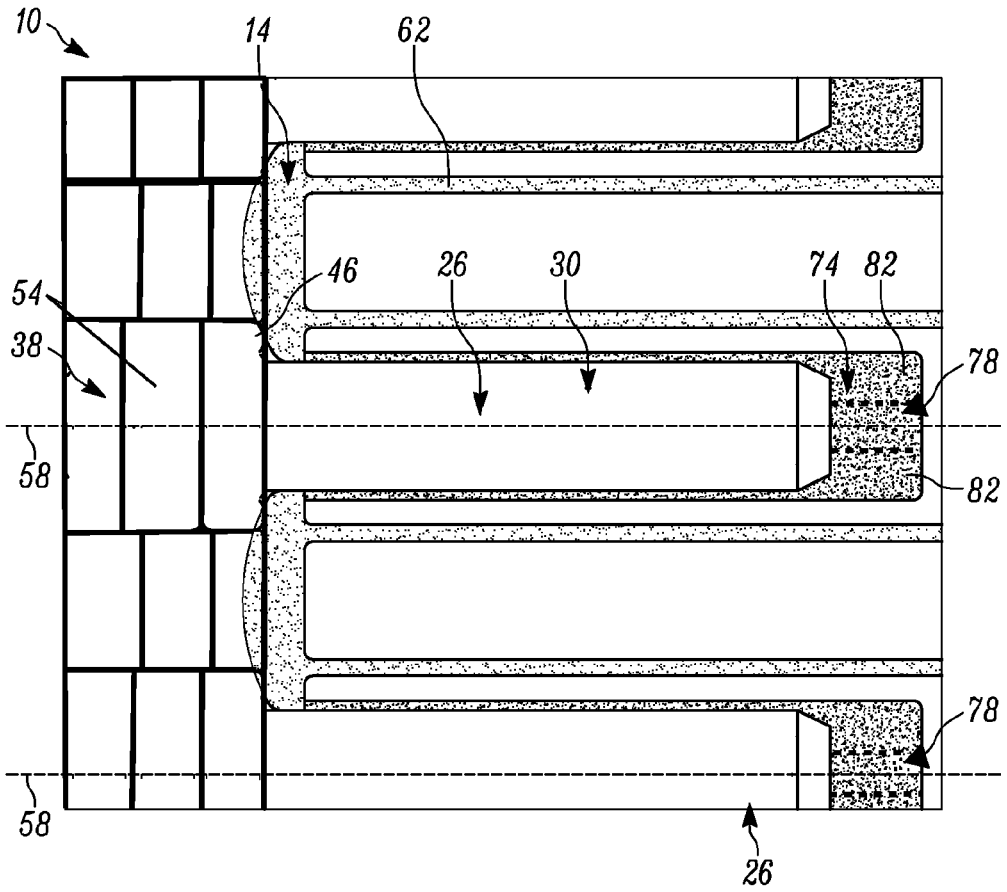
FIG. 6 illustrates the electrical contact pins of the connector system of FIG. 1, and solder pads for soldering the electrical contact pins to the printed circuit board.
Figure 7:
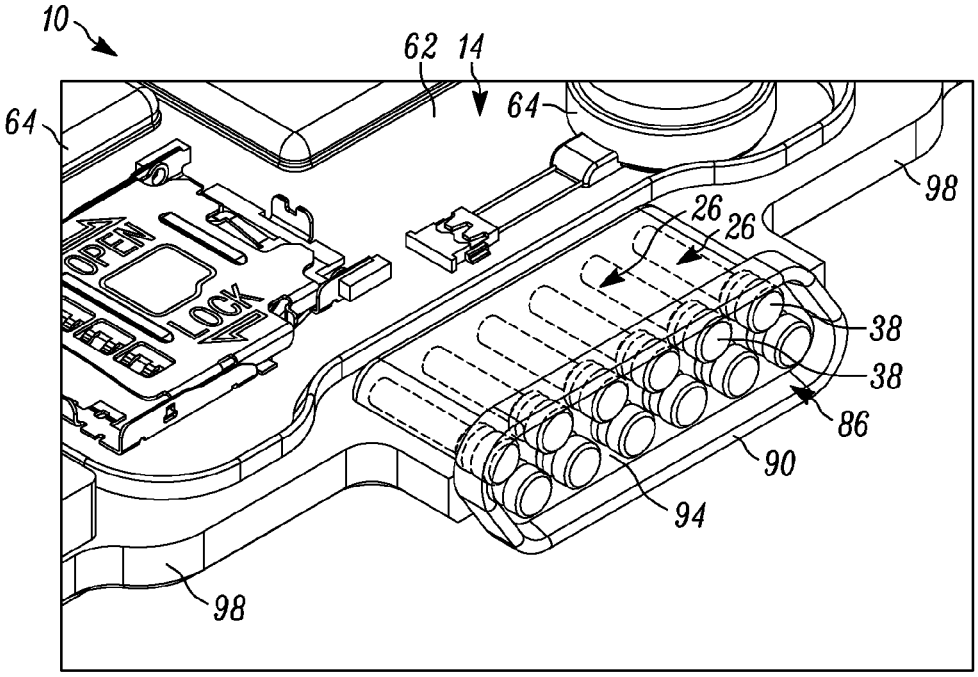
FIG. 7 illustrates the connector system of FIG. 1, showing portions of the electrical contact pins exposed outside of the sealing material.

With reference to FIGS. 5 and 6, the second portion 38 includes a ledge 46 that presses against a side surface 50 of the printed circuit board 14. The second portion 38 also includes a groove 54. In the illustrated embodiment, the ledge 46 is a circumferential ledge that extends entirely around the second portion 38. Only a portion of the ledge 46 directly contacts and presses against the side surface 50 of the printed circuit board 14. The groove 54 is a circumferential groove that extends entirely around the second portion 38. As illustrated in FIGS. 5 and 6, the electrical contact pin 26 is elongate, with a central axis 58 extending through the entire electrical contact pin 26. The ledge 46 is disposed axially between the first portion 30 and the groove 54 along the central axis 58.

With reference to FIGS. 4 through 6, the printed circuit board 14 includes a top surface 62 that receives and holds a plurality of circuit board components 64 (FIG. 4), as well as a bottom surface 66 (FIG. 5) that is disposed opposite and underneath the top surface 62. The top and bottom surfaces 62 and 66 are parallel to one another, and are connected to each other via the side surface 50, such that the side surface 50 extends perpendicular to each of the top and bottom surfaces 62, 66.

With reference to FIG. 6, the first portions 30 of six of the twelve electrical contact pins 26 are soldered directly onto the top surface 62 via one or more solder pads 74. In the exemplary embodiment illustrated in FIG. 6, the solder pads 74 each have a central dividing area 78 that runs parallel to, or along, the central axis 58. This central dividing area 78 is a thin region of solder that separates two thicker regions 82 (e.g., mounds) of solder within the solder pads 74 on either side of the central dividing area 78. Use of the central dividing area 78 and the two thicker regions 82 causes the solder material in the two thicker regions 82 to creep up along one or more surfaces of the electrical contact pin 26 (i.e., along a direction generally coming out of the page on FIG. 6) as the solder material is heated, and to form at least one solder fillet, thereby securing the electrical contact pins 26 to the printed circuit board 14. As illustrated in FIG. 6, the solder pads 74, as well as the electrical contact pins 26, are positioned parallel to one another, such that each of the central dividing areas 78 is parallel to every other central dividing area 78, and each of the central axes 58 is parallel to every other central axis 58. The central dividing areas 78 and the two thicker regions 82 also help to center the electrical contact pins 26 along the central axes 58, and prevent the electrical contact pins 26 from skewing or twisting relative to the printed circuit board 14.

With reference to FIG. 5, as the solder material in the solder pad 74 hardens (i.e., as the solder material cools), the solder material pulls the ledge 46 axially along the central axis 58 toward the side surface 50, pressing the ledge 46 against the side surface 50. For example, in some embodiments, as the solder material hardens, one or more solder fillets 80 are formed (e.g., due to the creep described above) that aid in pulling the ledge 46 against the side surface 50. As illustrated in FIG. 5, in the illustrated embodiment at least one of the solder fillets 80 is disposed axially adjacent an end 81 of the electrical contact pin 26.

In the illustrated embodiment, the ledge 46 extends parallel to the side surface 50, such that a combination of the ledge 46 and the first portion 30 in cross-section (shown in FIG. 5) forms a ninety degree angle, thereby creating a tight fit against the ledge 46 and the top surface 62. The pressure of the ledge 46 against the side surface 50 inhibits the electrical contact pin 26 from skewing or twisting relative to the printed circuit board 14.

With reference to FIGS. 3 through 7, the remaining six electrical contact pins 26 are similarly soldered directly to the bottom surface 66 (FIG. 5) of the printed circuit board 14. However, these remaining six electrical contact pins 26 are alternated relative to the six electrical contact pins 26 that are directly coupled to the top surface 62, such that the central axis 58 of any one of the electrical contact pins 26 coupled directly to the top surface 62 and the central axis 58 of any one of the electrical contact pins 26 coupled directly to the bottom surface 66 are each disposed in a plane that extends at an oblique angle relative to the top surface 62 of the printed circuit board 14. In other embodiments, the spacing and positioning of the electrical contact pins 26 is different from that shown.

With reference to FIG. 5, each electrical contact pin 26 further includes a center of gravity 84 that aids in stabilizing the electrical contact pin 26. For example, as illustrated in FIG. 5, the center of gravity 84 is disposed inward of the side surface 50, and above the top surface 62, thereby helping to ensure that the electrical contact pin 26 does not fall or slide off of the printed circuit board 14 while the solder pad 74 hardens.

With reference to FIGS. 1 through 4 and FIG. 7, the connector system 10 further includes a sealing material 86 that is disposed within the groove 54 of at least one of the electrical contact pins 26. In the illustrated embodiment, the sealing material 86 is a silicone material that is disposed within and fills each of the grooves 54 of the twelve electrical contact pins 26, thereby helping to seal the electrical contact pins 26 and secure and hold each of the electrical contact pins 26 in place relative to one another. In other embodiments other types of material are used for the sealing material 86, including but not limited to Buna N nitrile and fluorosilicone. In the illustrated embodiment, the sealing material 86 is formed as a single piece having a lip 90 that protrudes away from and extends around the twelve electrical contact pins 26, thereby forming an opening 94 in which areas of the first portions 30 of the electrical contact pins 26 are exposed (e.g., for connection to, for example, a peripheral electronic device). As illustrated in FIGS. 2 through 4 and FIG. 7, the sealing material 86 further includes two arms 98 that extend from either side of the lip 90. The two arms 98 contact and/or wrap around a portion of the printed circuit board 14, thereby further providing an additional seal around a portion of the printed circuit board 14.

In the illustrated embodiment, to assemble the connector system 10 one of the electrical contact pins 26 is first pick and placed onto the printed circuit board 14, and soldered directly onto the top surface 62 of the printed circuit board 14 using the solder pad 74. Then, a second electrical contact pin 26 is pick and placed directly onto the printed circuit board 14, and soldered directly onto the top surface 62 using another solder pad 74. Then third, fourth, fifth, and sixth electrical contact pins 26 are similarly pick and placed and soldered onto the top surface 62. Once the initial set of six electrical contact pins 26 have been soldered in place, the printed circuit board 14 is turned over, and the remaining six electrical contact pins 26 are then individually soldered onto the bottom surface 66 of the printed circuit board 14 in a similar manner. This process allows for variations in numbering and spacing of the electrical contact pins 26 as desired.

Once all of the electrical contact pins 26 have been coupled (e.g., soldered) to the printed circuit board 14, the sealing material 86 is then applied over the electrical contact pins 26 and the printed circuit board 14 (e.g., flowed over). During this process, the sealing material 86 extends into each of the grooves 54 and hardens, leaving areas of the first portions 30 of the electrical contact pins 26 exposed for contact with a peripheral electronic device or piece of equipment, and providing a seal against the electrical contact pins 26 and the printed circuit board 14.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has," "having," "includes," "including," "contains," "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a," "has . . . a," "includes . . . a," or "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially," "essentially," "approximately," "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

We claim:

1. An electrical contact pin for a printed circuit board, the electrical contact pin comprising:

a first cylindrical portion having a first diameter; and a second cylindrical portion extending from the first cylindrical portion, the second cylindrical portion having a second diameter larger than the first diameter, the second cylindrical portion including a ledge configured to press against a wall of a printed circuit board, the second cylindrical portion further including a groove configured to receive a sealing material.

2. The electrical contact pin of claim 1, wherein the electrical contact pin is an elongate electrical contact pin extending along a central axis, and wherein the ledge is disposed axially between the first cylindrical portion and the groove along the central axis.

3. The electrical contact pin of claim 1, wherein the groove is a circumferential groove extending entirely around the second cylindrical portion.

4. The electrical contact pin of claim 1, wherein the ledge is a circumferential ledge.

5. The electrical contact pin of claim 1, wherein the first cylindrical portion has a first length and the second cylindrical portion has a second length, wherein the first length is larger than the second length.

6. A connector system comprising:

a printed circuit board having a top surface and a side surface extending from the top surface; and an electrical contact pin coupled to the printed circuit board, the electrical contact pin having a first cylindrical portion coupled directly to the top surface, the first cylindrical portion having a first diameter, the electrical contact pin having a second cylindrical portion extending from the first cylindrical portion, the second cylindrical portion having a second diameter larger than the first diameter, the second cylindrical portion including a ledge in direct contact with the side surface.

7. The connector system of claim 6, wherein the first cylindrical portion has a first length and the second cylindrical portion has a second length, wherein the first length is larger than the second length.

8. The connector system of claim 6, wherein the first cylindrical portion is soldered to the top surface with a solder fillet, and wherein the solder fillet pulls the ledge against the side surface.

9. The connector system of claim 6, wherein the ledge is a circumferential ledge, and wherein only a portion of the ledge directly contacts the side surface.

10. The connector system of claim 6, wherein the electrical contact pin is a first electrical contact pin, wherein the connector system includes a second electrical contact pin coupled to the printed circuit board, the second electrical contact pin having a first cylindrical portion coupled directly to the top surface, the first cylindrical portion of the second electrical contact pin having a first diameter, the second electrical contact pin having a second cylindrical portion extending from the first cylindrical portion of the second electrical contact pin, the second cylindrical portion of the second electrical contact pin having a second diameter larger than the first diameter of the second electrical contact pin, the second cylindrical portion of the second electrical contact pin including a ledge in direct contact with the side surface.

11. The connector system of claim 6, wherein the printed circuit board includes a bottom surface, wherein the electrical contact pin is a first electrical contact pin, wherein the connector system includes a second electrical contact pin coupled to the printed circuit board, the second electrical contact pin having a first cylindrical portion coupled directly to the bottom surface, the first cylindrical portion of the second electrical contact pin having a first diameter, the second electrical contact pin having a second cylindrical portion extending from the from the first cylindrical portion of the second electrical contact pin, the second cylindrical portion of the second electrical contact pin having a second diameter larger than the first diameter of the second electrical contact pin, the second cylindrical portion of the second electrical contact pin including a ledge in direct contact with the side surface.

12. The connector system of claim 11, wherein the first electrical contact pin includes a first central axis extending through the entire first electrical contact pin and the second electrical contact pin includes a second central axis extending through the entire second electrical contact pin, wherein the first and second central axes are each in a plane that extends at an oblique angle relative to the top surface of the printed circuit board.

13. A connector system comprising:

a printed circuit board having a top surface and a side surface extending from the top surface:

an electrical contact pin coupled to the printed circuit board, the electrical contact pin having a first cylindrical portion coupled directly to the top surface, the first cylindrical portion having a first diameter, the electrical contact pin having a second cylindrical portion extending from the first cylindrical portion, the second cylindrical portion having a second diameter larger than the first diameter, the second cylindrical portion including a groove; and a sealing material disposed within the groove.

14. The connector system of claim 13, wherein the first cylindrical portion has a first length and the second cylindrical portion has a second length, wherein the first length is larger than the second length.

15. The connector system of claim 13, wherein the groove is a circumferential groove extending entirely around the second cylindrical portion.

16. The connector system of claim 13, wherein the sealing material is silicone.

17. The connector system of claim 13, wherein the second cylindrical portion includes a ledge in direct contact with the side surface.

18. The connector system of claim 13, wherein the electrical contact pin is a first electrical contact pin, wherein the connector system includes a second electrical contact pin coupled to the printed circuit board, the second electrical contact pin having a first cylindrical portion coupled directly to the top surface, the first cylindrical portion of the second electrical contact pin having a first diameter, the second electrical contact pin having a second cylindrical portion extending from the first cylindrical portion of the second electrical contact pin, the second cylindrical portion of the second electrical contact pin having a second diameter larger than the first diameter of the second electrical contact pin, the second cylindrical portion of the second electrical contact pin including a groove, wherein the sealing material is disposed within the grooves of both the first electrical contact pin and the second electrical contact pin.

19. The connector system of claim 13, wherein the printed circuit board includes a bottom surface, wherein the electrical contact pin is a first electrical contact pin, wherein the connector system includes a second electrical contact pin coupled to the printed circuit board, the second electrical contact pin having a first cylindrical portion coupled directly to the bottom surface, the first cylindrical portion of the second electrical contact pin having a first diameter, the second electrical contact pin having a second cylindrical portion extending from the from the first cylindrical portion of the second electrical contact pin, the second cylindrical portion of the second electrical contact pin having a second diameter larger than the first diameter of the second electrical contact pin, the second cylindrical portion of the second electrical contact pin including a groove, wherein the sealing material is disposed within the grooves of both the first electrical contact pin and the second electrical contact pin.

20. The connector system of claim 19, wherein the first electrical contact pin includes a first central axis extending through the entire first electrical contact pin and the second electrical contact pin includes a second central axis extending through the entire second electrical contact pin, wherein the first and second central axes are each in a plane that extends at an oblique angle relative to the top surface of the printed circuit board.

* * * * *